US005364020A

United States Patent [19]

Bansal

[11] Patent Number: 5,364,020

[45] Date of Patent: Nov. 15, 1994

[54] SECOND GENERATION CLAMPAK EASY DISPLAY SHIPPER

[75] Inventor: Vinod Bansal, Edison, N.J.

[73] Assignee: Thomas J. Lipton Co., Division of Conopco, Inc., Englewood Cliffs, N.J.

[21] Appl. No.: 34,038

[22] Filed: Mar. 22, 1993

[51] Int. Cl.[5] ..... B65D 5/54; B65D 5/66

[52] U.S. Cl. ..... 229/145; 206/44 R; 229/164; 229/240

[58] Field of Search ..... 229/40, 145, 164, 190, 229/240; 206/427, 44 R

[56] References Cited

U.S. PATENT DOCUMENTS

| | | | |
|---|---|---|---|
| 2,119,058 | 5/1938 | Richardson | 229/145 |
| 2,862,612 | 12/1958 | Brown | 229/240 |
| 2,922,560 | 1/1960 | Midnight . | |
| 2,955,734 | 10/1960 | Barton | 229/145 |
| 3,015,430 | 1/1962 | Bauer | 229/145 |
| 3,019,959 | 2/1962 | Skowronski | 229/145 |
| 3,185,382 | 5/1965 | Nunn | 206/44 R |
| 3,372,794 | 3/1968 | Kohlhaas | 206/44 R |
| 3,454,209 | 7/1969 | Persson | 229/145 |
| 3,640,449 | 2/1972 | Bastian | 229/240 |
| 3,680,767 | 8/1972 | DeLorenzo et al. | 229/145 |
| 3,881,648 | 5/1975 | Hall | 229/164 |
| 4,201,330 | 5/1980 | Gilbert | 229/145 |
| 4,284,193 | 8/1981 | Roccaforte | 229/240 |
| 4,391,405 | 7/1983 | Drinon | 229/145 |
| 4,488,675 | 12/1984 | von Gnechten et al. | 229/145 |
| 4,574,945 | 3/1986 | Giblin . | |
| 4,946,042 | 8/1990 | Ferreri et al. . | |

*Primary Examiner*—Gary E. Elkins
*Attorney, Agent, or Firm*—James J. Farrell

[57] ABSTRACT

A shipping display case is provided which employs attenuated side panels to take advantage of the compressive strength contribution of contained articles.

6 Claims, 2 Drawing Sheets

SECOND GENERATION CLAMPAK EASY DISPLAY SHIPPER

FIELD OF THE INVENTION

The present invention relates generally to cases and more specifically to readily openable combination shipping and display cases for bottles or containers or the like. The case can be converted easily from a shipping case into a display case for exposing the contents without removing the contents from the case. The cases of this invention have eliminated certain extraneous panels to take full advantage of the additional compressive strength contributed by the contents while enjoying a benefit in the reduction of both cost and the environmental load associated with multi paneled cases.

BACKGROUND OF THE INVENTION

Dual purpose shipping and display cases having removable sections or panels fully or partially defined by perforated tear lines are known. such cases are typically formed from a one-piece blank which has been suitably cut and scored to enable subsequent folding of the blank into a closed case. The removable section(s) is generally defined at least in part by a plurality of perforated lines and may be separated from the closed case by loosening the section from the other part of the case and then tearing along the perforated lines.

The display function of the case is necessary for use in related outlets such as supermarkets, discount stores and the like to enable display of selected products without it being necessary to shelve them.

The inclusion of perforation lines to enable display by easy removal of portions of the case reduces the structural integrity of the case. Unwanted opening of these lines exposes and subjects the articles contained therein to loss or theft, resulting in delayed or untilled orders, spillage, and ultimately increased expense to consumers.

Generally, shipping/display cases are stacked one upon the other to conserve space. This imposes certain stresses on the cases. The cases thus require a certain compressive strength to resist crushing stress from excessive weight. The lower layers must support the weight of the cases above them and this imposes a strain, especially on the vertical portions of the lower container. U.S. Pat. No. 2,922,560, for example, deals with strengthening various vertical portions of a case.

Stressful treatment of the cases is to some extent uncontrollable, e.g., tall heavy stacks of the filled cases are commonly needed or used for maximum efficient utilization of warehouse or cargo space, which develops high stress on the lower layers of the stacks. Also, inadvertent opening is especially likely during storage or shipment of relatively heavy articles.

The problem of inadvertent opening of perforation lines as well as crushing of the cases is compounded by the desire to employ as little case material, i.e., case weight, as possible, in the interest of materials cost savings. A reduction of the case weight is accompanied by a diminution in case strength and capability of containing articles without tearing, especially for articles of substantial weight. Thus, while cases of lesser weight, i.e., less material, thinner panels and flaps, etc., are desirable from an economic point of view, as well as for ease of removing the removable sections, structurally strong and stable cases which reliably contain the contents therein during shipping and handling are equally desirable. These objectives are at cross purposes and no combination shipping and display case is known which optimally balances these competing objectives.

The ratio of the weight of the contents of the case to the weight of the case itself may be viewed as a measure of packaging efficiency. Thus, higher ratios correspond to more efficient packaging. However, there are practical limits beyond which the case strength is so low relative to the load that a reliable package is not feasible. Furthermore, this ratio is generally less for cases having removable sections due to the inclusion of perforation lines, compared to the generally stronger cases that can be fabricated without removable sections.

The difficulty of known dual purpose cases in reliably containing bottles or containers in a case of minimum weight, is compounded by the desire for large removable sections. Large removable sections are desired to permit a substantial and attractive display of the articles and to facilitate removal of unit amounts thereof from retail shelves or counters by purchasers. However, large removable sections weaken correspondingly large portions of the relatively light weight case.

T. J. Lipton Company has employed a commercial shipping and display case for products such as salad dressings which employs full side and rear panels to assist in providing compressive strength to cases to resist crushing caused by stacking or other forces which act on the top of the lower tiers of cases. Other combination shipping, display cases have been used, for example, U.S. Pat. No. 4,946,042, provides an easily openable cut out portion of a shipping case to facilitate display of the contents. U.S. Pat. No. 4,574,945 deals with a shipping display case which has an integral liner to help protect the contents from cuts when the shipping case is converted to its display function.

Cases with additional liners and strengthening panels employ more corrugated board than shipping display cases without these additional strengthening and protective layers. In view of the ever increasing load of solid waste, it is, of course, desirable to avoid any excess use of paperboard or corrugated board. While still maintaining the compressive strength necessary to substantially avoid crushing of the lower tiers of cases in stacks and enabling easy conversion from shipping to display mode without employing protective panels and shields.

SUMMARY OF THE INVENTION

It is, therefore, an object of the present invention to provide a shipping-display case which substantially overcomes one or more of the disadvantages of the prior art with the advantage of using less corrugated board. This is desirable from both environmental and economic view points.

A further object is to produce a shipping-display case with sufficient compressive strength to avoid crushing by taking advantage of the additional compressive strength contributed by the enclosed articles such as, for example, bottles or containers.

The present invention, therefore, employs shorter side panels and glue flaps of attenuated dimensions to take advantage of the strength contributed by the contained articles. The side flaps thus preferably meet or overlap slightly but may even be sufficiently short so that they are only used to control the bottles or containers while providing little or no compressive strength to the overall case. The glue flaps, in like manner, are also shortened since again the compressive strength contribution of the contained articles such as bottles provides sufficient support. The tear out portion of the case eliminates the need for liners to shield the contained articles from cuts when the shipping case is converted to display mode.

The present invention may, therefore, be characterized as a shipping/display case as well as a fiberboard or corrugated board blank to be folded into a product shipping case and converted subsequently into a product display case. The blank being characterized by side flaps each of which vary from 25% to 75% of the width of the rear or second front flap.

BRIEF DESCRIPTION OF THE DRAWINGS

Further objects and advantages of the invention will become apparent from the following description and accompanying drawings in which.

Figure 1:
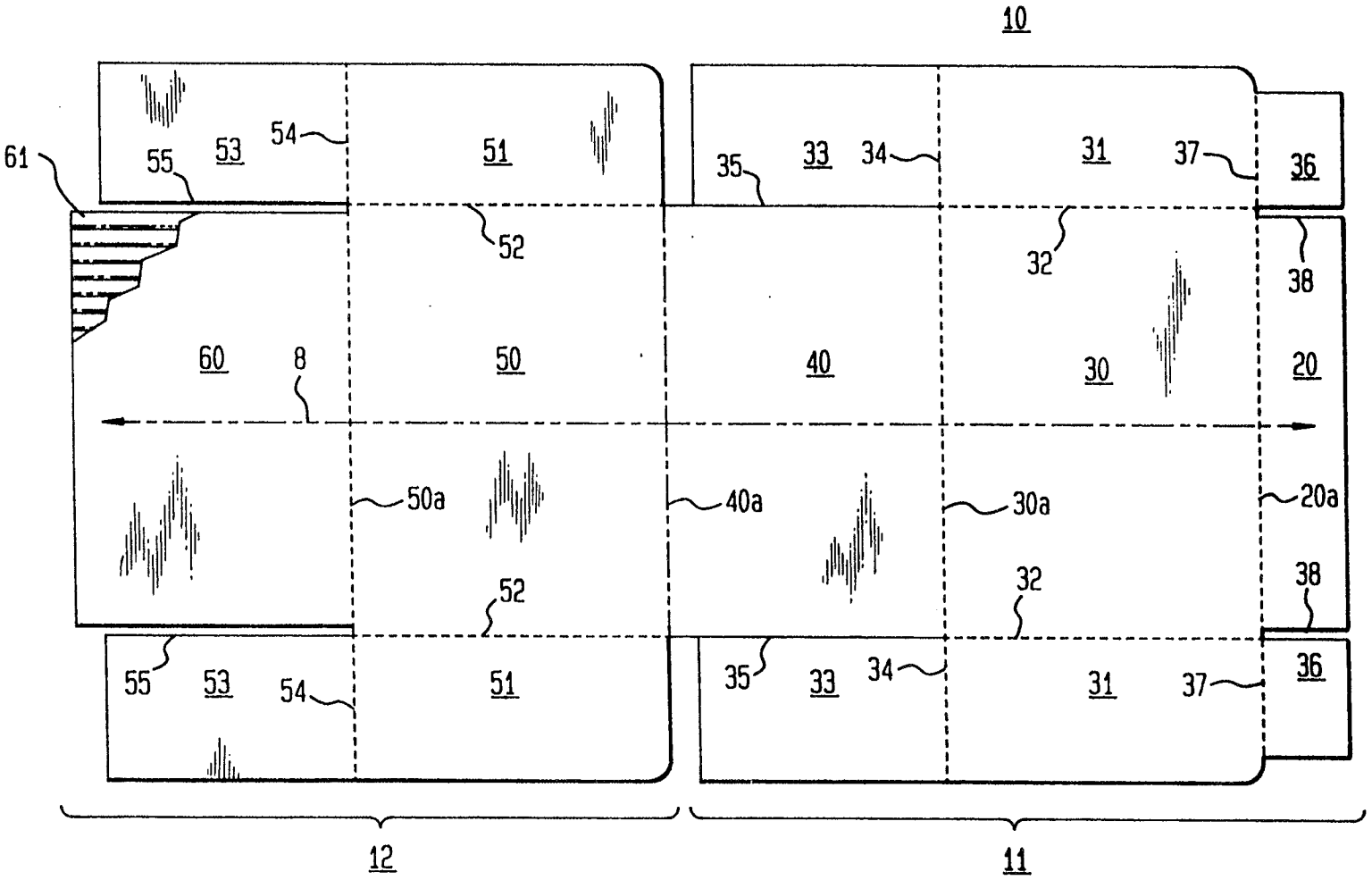
FIG. 1 is a plan view illustrating a preferred embodiment of the blank of the present invention before folding.

The present invention provides a readily openable shipping and display case which balances the strength of the case with the articles contained in the case to take full advantage of the additional compressive strength contributed by the contained articles such as bottles and the like.

A case blank adapted to form a container is provided having along a central longitudinal axis in order, a front panel, a bottom panel with a front and a rear edge, a rear panel, a top panel having a front and a rear edge, and a second front panel.

The front panel is separated from the bottom panel by an intact fold score line transverse to the longitudinal axis. If desired, this could be a transverse perforation score line. Transverse as used herein refers to lines that are transverse to the longitudinal axis.

The bottom panel is separated from the rear panel by a transverse intact fold/score line.

The rear panel is separated from the top panel by a transverse perforation/score line and the top panel is separated from the second front panel by a transverse intact fold/score line. These panels are adapted to form a container or sleeve when folded inward toward each other. The second front panel lying preferably outside of the front panel and being affixed thereto.

The bottom and the top panels each have integral side panels with intact fold/score lines extending along their length parallel to the longitudinal axis to enable the side panels to be folded inwards so as to produce a substantially right angle between the integral top side panels and the top and the integral bottom side panels and the bottom. The sum of the width of opposing top and bottom side panels may vary between 50% to 150% of the width of either the rear or the second front panel.

Each of the integral bottom side panels has a first bottom side flap on one end connected to it by an intact fold/score line. This bottom side flap extends along and parallel to the rear panel and is separated from the rear panel by a longitudinal cut.

Each first bottom side flap is adapted to be folded toward the integral bottom side panel to form substantially a 90° angle and then when the integral bottom side panel is folded toward the bottom panel the first bottom side flap is disposed transverse to the longitudinal axis along the rear edge of the bottom panel and can be used as a glue flap to secure the rear panel when the rear panel is folded inward toward the bottom panel.

In addition each of the integral bottom side panels has a second bottom side flap on the second end connected to it by a transverse intact fold/score line, but this line can also be a perforation/score line. The second bottom side flap extends from the integral bottom side panel along and parallel to the front panel and is separated from the front panel by a longitudinal cut.

Each second bottom side flap is adapted to be folded toward the integral bottom side panel to form a substantially 90° angle and then when the integral bottom side panel is folded toward the bottom panel, the second bottom side flap is disposed transverse to the longitudinal axis and along the front edge of the bottom panel and can be used as a glue flap to secure the front panel when the front panel is folded inward toward the bottom panel.

The integral bottom side panels together with the bottom, rear and front panels thus can form a tray with the first bottom side flaps used as glue flaps for the rear panel and the second bottom side flaps used as glue flaps for the front panel.

Each of the integral top side panels has a rear end top side flap connected to it by a transverse fold/score line. This rear end top side flap extends along and parallel to the second front panel and is separated from the second front panel by a longitudinal cut.

Each rear end top side flap is adapted to be folded toward the integral top side panel to form a substantially 90° angle with it and then when the integral top side panel is folded inward toward the top panel the rear end top side flap is disposed transversely to the longitudinal axis along the rear edge of the top panel and can be used as a glue flap to secure the second front panel when the second front panel is folded inward toward the top panel.

The integral top side panels together with the rear end top and second front panels and thus form a hood with the rear end top side flaps used as glue flaps for the second front panel.

The hood and the tray are connected through the perforation/score line transverse to the longitudinal axis along the rear of the rear panel. the second front panel may be glued or otherwise affixed to the front panel to form the case for shipping articles. When the case is used as a display case, the hood is removed from the tray by removing the second front panel from the front panel and tearing along the perforation at the rear of the rear panel.

DETAILED DESCRIPTION OF THE INVENTION

Referring to FIG. 1, there is depicted in a flat unfolded state, a case blank 10 of the presently preferred embodiment of the invention. Blank 10 comprises a front panel 20, a bottom panel 30, a rear panel 40, a top panel 50 and a second front panel 60 all lying along a longitudinal axis 8.

The front panel 20 is connected to the bottom panel 30 by a transverse intact fold/score line or perforation/-score line 20A. The bottom panel 30 is connected to the rear panel 40 by a transverse intact fold/score line 30A. The rear panel 40 is connected to the top panel 50 by a transverse perforation/score line 40A. The top panel 50 is connected to the second front panel 60 by a transverse intact fold/score line 50A.

The bottom panel 30 is integrally formed with the integral bottom side panels 31 which are separated from the bottom panel 30 by the longitudinal intact fold/-score lines 32.

The integral bottom side panels 31 have first bottom side flaps 33 and are connected thereto by the intact transverse fold/score lines 34. The first bottom side flaps 33 are separated from the rear panel 40 by the longitudinal cuts 35. In addition, the integral bottom side panels 31 have second bottom side flaps 36 and are connected thereto by the transverse fold/score lines 37 which may be either intact or perforated. The second bottom side flaps 36 are separated from the front panel 20 by longitudinal cuts 38.

The top panel 50 is integrally formed with the integral top side panels 51 which are separated from the top panel 50 by the longitudinal fold/score lines 52.

The integral top side panels 51 have rear end top side flaps 53 and are connected thereto by transverse fold/-score lines 54. The rear end top side flaps 53 are separated from the second front panel 60 by the longitudinal cuts 55.

The blank 10 preferably is further provided with means for fastening together the panels to form a case such as by glue or the like.

Figure 3:
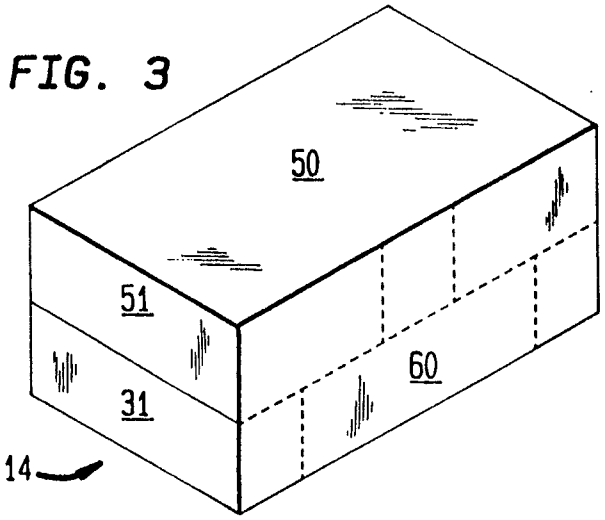
FIG. 3 is a perspective view of the preferred fully closed case of the present invention.

Referring now to FIG. 3, there is depicted the case blank of the present invention in a closed or folded state. Typically in operation, the blank is formed into a closed case composed of a tray 11 and a hood 12 by folding the integral bottom side panels 31 along the fold/score lines 32 toward the bottom panel 30 to form a substantially 90° angle. The first bottom side flaps 33 are then folded inwards towards the panel 31 along the fold/score lines 34 so that the flaps 33 from a 90° angle with the panel 31 and are transverse to the longitudinal axis and lie along the fold/score line 30A.

The rear panel 40 is folded towards the bottom panel 30 along the fold/score line 30A to form a substantially 90° angle with the bottom panel 30 and up against the transversely disposed first bottom flaps 33. The rear panel 40 is then affixed to the flaps 33.

Next, typically the tray is filled with bottles by sweeping or other means. The second bottom flaps 36 are then folded toward the integral bottom side panel 31 along the fold/score lines 37 at a substantially 90° angle.

The front panel 20 is then folded towards the bottom panel 30 along the perforation/score line or intact fold/score line 20A to form a substantially 90° angle therewith and up against the transversely disposed second bottom flaps 36. The front panel 20 is then affixed to the flaps 36.

This folded configuration thus forms a filled tray 11 connected to the rest of the blank by the perforation/-score line 40A. The integral top side panels are then folded along the fold/score lines 52 towards the top panel 50 to form a substantially 90° angle with the top panel 50.

The rear end top side flaps 53 are folded along the fold/score lines 54 towards the integral top side panels 51 to form a substantially 90° angle with the integral top side panels 51. The top side flaps 53 are then disposed transversely along the fold/score line 50A.

The second front flap 60 is then folded along the fold/score line 50A to form a substantially 90° angle with the top panel 50 and up against the rear end top side flaps 53. The second front panel is then affixed to the flaps 53.

The folded configuration thus forms a hood 12. To form the case of FIG. 3 the hood 12 is then folded along perforation/score line 40A over the tray 11 and the second front panel 60 is affixed to the front panel 20 to form the final case 14.

As can be readily seen from FIG. 3, the integral top side panels 51 meet with the integral bottom side panels 31 but do not overlap. This is made possible by the stored contents of the case which contribute substantially to the compressive strength of the overall shipping display case. This results in a more economical case which is lighter but which does not easily crush under compressive stress.

Figure 4:
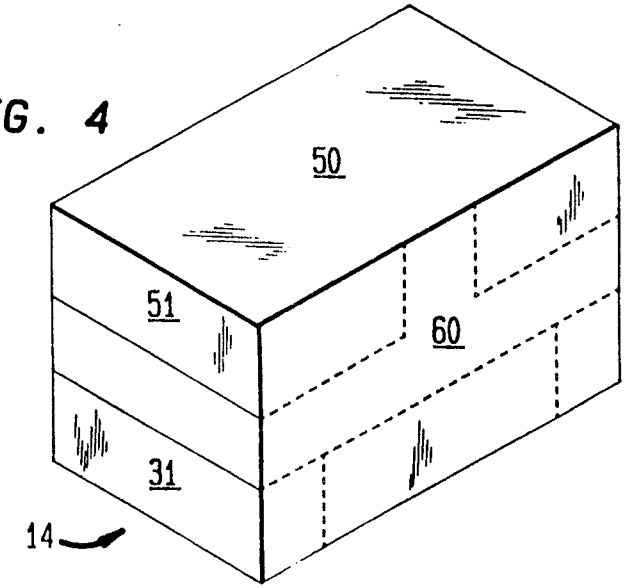
FIG. 4 is a perspective view of an alternate embodiment of the fully closed case of the present invention.

These panels in various embodiments can be made so as to leave a gap as shown in FIG. 4 and even to overlap but it is preferred that the side panels meet. Thus, the sum of the widths of one integral top side panel 51 plus one opposing integral bottom side panel 31 can vary. This variation can be about 150% or more of the width of the rear panel 40 or the second front panel 60. Where there is an overlap of about 50% for both side panels, then if both the top side panel 51 and bottom side panel 31 have the same width the overlap is about 25% for each panel. The variation in the sum of the width of the sides can also be about 50% or less of the width of the rear panel 40 or the second front panel 60, where there is a gap of about 50% or more of the width of the rear panel 40 or the second front panel 60. It will be evident that the opposing top and bottom side flaps may have the same width or different widths depending on the design. Indeed, by selecting the appropriate dimensions and case strength the side panels 51 and 31 need only extend from the top and bottom far enough to prevent the contained materials from falling out of the case.

Figure 2:
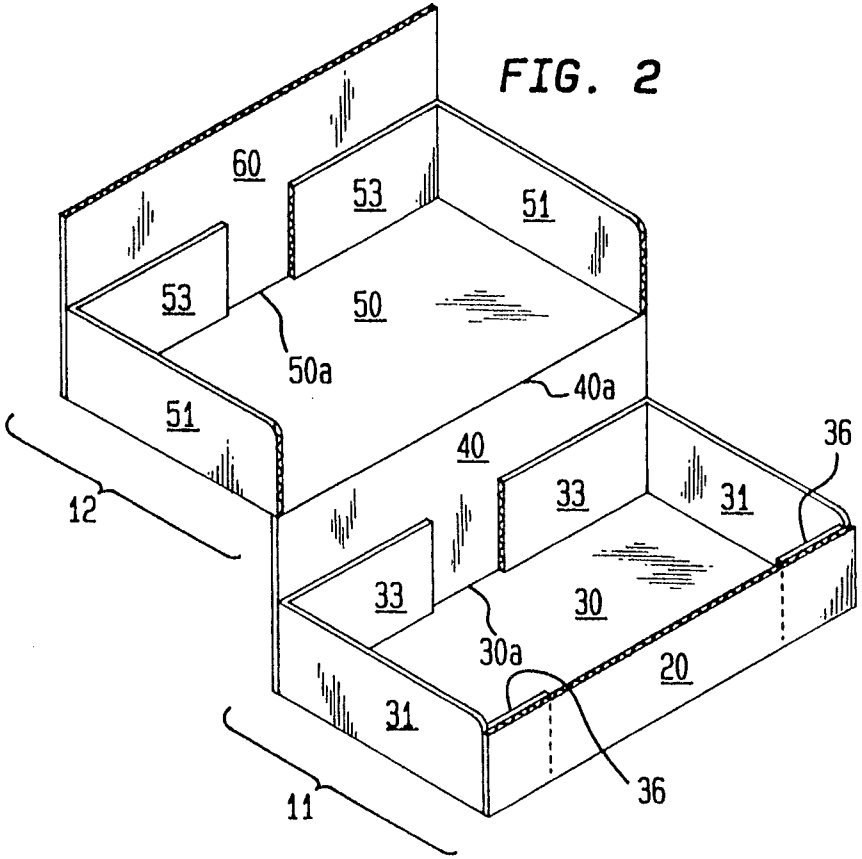
FIG. 2 is a perspective view of the blank of FIG. 1 of the present invention in an intermediary stage of folding.

In like manner, from FIG. 2 it is evident that the second bottom side flaps 36 do not necessarily meet with the top side flaps 53. This again takes advantage of the strength of the contained materials. Indeed, these flaps may be attenuated even more, so that they provide only a surface to glue the cases together.

In FIG. 4 a less preferred embodiment is shown having a gap between the side panels 51 and 31. In this embodiment the sum of their widths is less than 100% of the width of the rear or the second front panel 60.

The material from which the case is fabricated can be heavy fiberboard obtained in the usual manner or can be single or double walled corrugated paperboard also prepared in a manner known to the art. It should be noted that corrugated sheet incorporates a layer having flutes fabricated in it. This fluted sheet may also have additional walls glued to it so as to form a sandwich with the flutes being intermediate of the outer layers.

These flutes contribute to the strength of the overall corrugated sheet or board. Compressive strength of the corrugated paperboard is better when applied to the board in a direction parallel to the flutes. Thus, when the blank 10 is formed from corrugated board the flutes preferably lie along or parallel to the longitudinal axis of the blank 10 although preferred, it is not critical for the blank 10 to have the flutes parallel to the longitudinal axis because the strength contributed by the contained material may be sufficient for the overall strength of the case. If corrugated board is to be used, however, it is customary to take advantage of the strength characteristics contributed by fabricating the board so that the flutes typically lie parallel to the longitudinal axis 8.

FIG. 1 shows the blank 10 with cutout portion 61 of the second front panel. This cutout portion show the fluting parallel to the longitudinal axis 8 of the blank 10.

While it is apparent that the invention herein disclosed is especially effective to fulfill the objects stated above, it will be appreciated that numerous modifications and embodiments may be devised by those skilled in the art, and it is intended that the appended claims cover all such modifications and embodiments as fall within the spirit and scope of the present invention.

What is claimed is:

1. A case blank having a longitudinal axis and adapted to form a container comprising:

a) a front panel connected to a bottom panel, said bottom panel also being connected to a rear panel;

b) said bottom panel, having integral bottom side panels connected along their length to said bottom panel by longitudinal fold lines, each of said integral bottom side panels having first bottom side flaps extending longitudinally therefrom along said rear panel and each of said integral bottom side panels having second bottom side flaps extending longitudinally therefrom along said front panel, each of said first bottom side flaps being connected along their width to each of said integral bottom side panels by transverse fold lines and being separated from said rear panel by longitudinal cuts, each of said second bottom side flaps being connected along their width to each of said integral bottom side panels by transverse fold lines and being separated from said front panel by longitudinal cuts;

c) a top panel connected to said rear panel and having integral top side panels connected along their length to said top panel by longitudinal fold lines, each of said integral top side panels having top side flaps extending longitudinally therefrom and each of said top side flaps being connected along their width to each of said integral top side panels by transverse fold lines;

d) a second front panel connected to said top panel;

e) fastening means adapted for fastening said second front panel to said front panel;

f) said blank being characterized by having the dimensions of said integral bottom side panels and integral top side panels such that when said blank is folded to form a container the sum of the width of an opposing pair of one of said integral bottom side panels and one of said integral top side panels is equal to the width of the second front panel or the width of the rear panel so that when the blank is folded into a container the dimensions of the side of the container formed from the opposing pair of said integral bottom side panel and said integral top side panel is equal to the width of the second front panel or the rear panel.

2. A blank as defined in claim 1 fabricated from corrugated board, or fiberboard.

3. A blank as defined in claim 2 fabricated from corrugated board and having the corrugation flutes parallel to the longitudinal axis of the blank.

4. A case formed from a single piece blank of foldable material and adapted to contain, display and allow removal of a plurality of articles comprising:

a) a bottom panel having a front and a rear edge and a pair of side panels, said side panels being integrally connected to said bottom panel along intact fold lines each of said side panels having a first bottom side flap connected to one end of each of said side panels and a second bottom side flap connected to the second end of each of said side panels and each of said first bottom side flaps being folded along the rear edge of said bottom panel and each of said second bottom side flaps being folded along the front edge of said bottom panel;

b) a front panel connected along the front edge of said bottom panel by a perforation line and being folded up against said folded second bottom side flaps and being affixed thereto, in right angle relationship with said bottom;

c) a rear panel connected along the rear edge of said bottom panel by an intact fold line and being folded up against said folded first bottom side flaps and being affixed thereto in right angle relationship with said bottom;

d) a top panel having a front and a rear edge connected along said rear edge by a perforation line to said rear panel and said top panel having a pair of top side panels, each of said top side panels being integrally connected to said top panel along intact fold lines, each of said top side panels having a rear end top flap connected to each of said top side panels by an intact fold line and said rear end top flaps being folded along the rear edge of said top panel;

e) a second front panel connected along the rear edge of said top panel by an intact fold line and being folded up against said folded rear end top flaps and being affixed to said folded rear end top flaps in right angle relationship with said top to form a hood wherein said hood formed by said top panel and said top side panls and said second front panel is folded down over said bottom panel and affixed to said front panel, wherein the sum of the width of an opposing integral top side panel plus an integral bottom side panel is equal to the width of said second front or said rear panel and whereby the second front panel together with the top panel and integral top side panels can be removed from the front, the rear and the bottom panel with integral bottom sides by tearing along the perforation line forming the rear edge of the top panel.

5. A case blank having a longitudinal axis and adapted to form a container comprising:

a) a front panel connected to a bottom panel, said bottom panel also being connected to a rear panel;

b) said bottom panel having integral bottom side panels connected along their length to said bottom panel by longitudinal fold lines, each of said integral bottom side panels having first bottom side flaps extending longitudinally therefrom along said rear panel and each of said integral bottom side panels having second bottom side flaps extending longitudinally therefrom along said front panel, each of said first bottom side flaps being connected along their width to each of said integral bottom side panels by transverse fold lines and being separated from said rear panel by longitudinal cuts, each of said second bottom side flaps being connected along their width to each of said integral bottom side panels by transverse fold lines and being separated from said front panel by longitudinal cuts;

c) a top panel connected to said rear panel and having integral top side panels connected along their length to said top panel by longitudinal fold lines, each of said integral top side panels having top side flaps extending longitudinally therefrom and each of said top side flaps being connected along their width to each of said integral top side panels by transverse fold lines;

d) a second front panel connected to said top panel;

e) fastening means adapted for fastening said second front panel to said front panel;

f) said blank being characterized by having the dimensions of said integral bottom side panels and integral top side panels such that when said blank is folded to form a container the sum of the width of an opposing pair of one of said integral bottom side panels and one of said integral top side panels is less than the width of the second front panel or the width of the rear panel so that when the blank is folded into a container the dimensions of the side of the container formed from the opposing pair of said integral bottom side panel and said integral top side panel is less than the width of the second front panel or the rear panel.

6. A case formed from a single piece blank of foldable material and adapted to contain, display and allow removal of a plurality of articles comprising:

a) a bottom panel having a front and a rear edge and a pair of side panels, said side panels being integrally connected to said bottom panel along intact fold lines, each of said side panels having a first bottom side flap connected to one end of each of said side panels and a second bottom side flap connected to the second end of each of said side panels and each of said first bottom side flaps being folded along the rear edge of said bottom panel and each of said second bottom side flaps being folded along the front edge of said bottom panel;

b) a front panel connected along the front edge of said bottom panel by a perforation line and being folded up against said folded second bottom side flaps and being affixed thereto, in right angle relationship with said bottom;

c) a rear panel connected along the rear edge of said bottom panel by an intact fold line and being folded up against said folded first bottom side flaps and being affixed thereto in right angle relationship with said bottom;

d) a top panel having a front and a rear edge connected along said rear edge by a perforation line to said rear panel and said top panel having a pair of top side panels, each of said top side panels being integrally connected to said top panel along intact fold lines, each of said top side panels having a rear end top flap connected to each of said top side panels by an intact fold line and said rear end top flaps being folded along the rear edge of said top panel;

e) a second front panel connected along the rear edge of said top panel by an intact fold line and being folded up against said folded rear end top flaps and being affixed to said folded rear end top flaps in right angle relationship with said top to form a hood wherein said hood formed by said top panel and said top side panels and said second front panel is folded down over said bottom panel and affixed to said front panel, wherein the sum of the width of an opposing integral top side panel plus an integral bottom side panel is less than the width of said second front or said rear panel and whereby the second front panel together with the top panel and integral top side panels can be removed from the front, the rear and the bottom panel with integral bottom sides by tearing along the perforation line forming the rear edge of the top panel.

* * * * *